US007140915B2

(12) United States Patent
Casses et al.

(10) Patent No.: US 7,140,915 B2
(45) Date of Patent: Nov. 28, 2006

(54) RETAINING DEVICE FOR AN IMPROVED CONTACT

(75) Inventors: Claude Casses, Clevilliers (FR); Gérard Mulot, Nogent le Roi (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/522,294

(22) PCT Filed: Jul. 16, 2003

(86) PCT No.: PCT/FR03/02244

§ 371 (c)(1),
(2), (4) Date: Aug. 4, 2005

(87) PCT Pub. No.: WO2004/013936

PCT Pub. Date: Feb. 12, 2004

(65) Prior Publication Data

US 2006/0035519 A1 Feb. 16, 2006

(30) Foreign Application Priority Data

Jul. 31, 2002 (FR) ..... 02 09767

(51) Int. Cl.
*H01R 13/40* (2006.01)

(52) U.S. Cl. ..... 439/592; 439/752

(58) Field of Classification Search ..... 439/594–596, 439/744, 752

See application file for complete search history.

(56) References Cited

U.S. PATENT DOCUMENTS

| | | | | |
|---|---|---|---|---|
| 3,781,760 | A * | 12/1973 | Mancini et al. | 439/595 |
| 3,944,312 | A * | 3/1976 | Koenig | 439/357 |
| 4,295,698 | A * | 10/1981 | Chow | 439/595 |
| 4,969,841 | A | 11/1990 | Sueyoshi et al. | |
| 5,190,476 | A | 3/1993 | Chaillot | |
| 5,746,624 | A | 5/1998 | Ohsumi et al. | |
| 5,836,796 | A | 11/1998 | Danroc | |
| 6,068,512 | A | 5/2000 | Sugie | |
| 6,729,904 | B1 * | 5/2004 | Nankou et al. | 439/595 |
| 6,796,836 | B1 * | 9/2004 | Ichida et al. | 439/595 |
| 2006/0035519 | A1 * | 2/2006 | Casses et al. | 439/592 |

FOREIGN PATENT DOCUMENTS

| | | |
|---|---|---|
| FR | 2 818 027 | 6/2002 |
| GB | 1 281 009 | 7/1972 |
| GB | 1 509 202 | 5/1978 |

* cited by examiner

*Primary Examiner*—James R. Harvey
(74) *Attorney, Agent, or Firm*—Harrington & Smith, LLP

(57) ABSTRACT

The invention relates to a retaining device for maintaining an electric contact (24) in the connector socket (22) of a connection box (20). The inventive device comprises a bearing surface (50) interacting with a shoulder (52) which is arranged on the level of said contact (24) and is characterised in that the bearing surface and the shoulder (52) are provided with supplementary nonplanar profiles in such a way that the thus obtained contact plane has a larger contact surface than the contact planes having the equal size across the width thereof.

15 Claims, 2 Drawing Sheets

ART ANTERIEUR
Fig. 1A
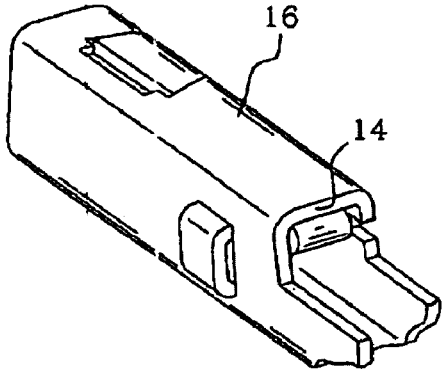
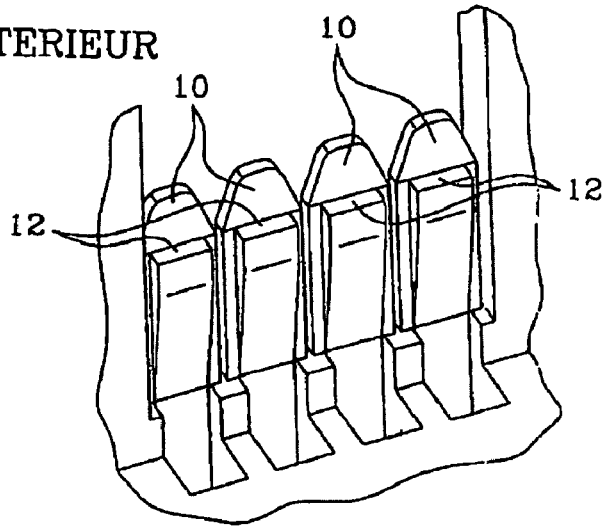
Fig. 1B
Fig. 2A
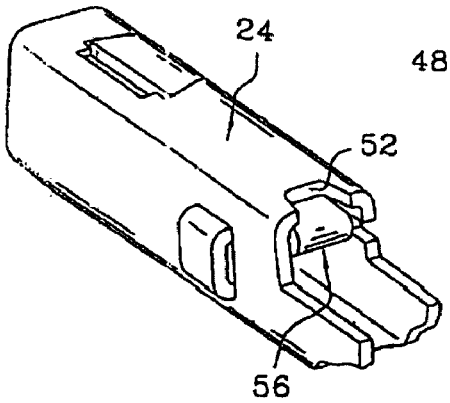
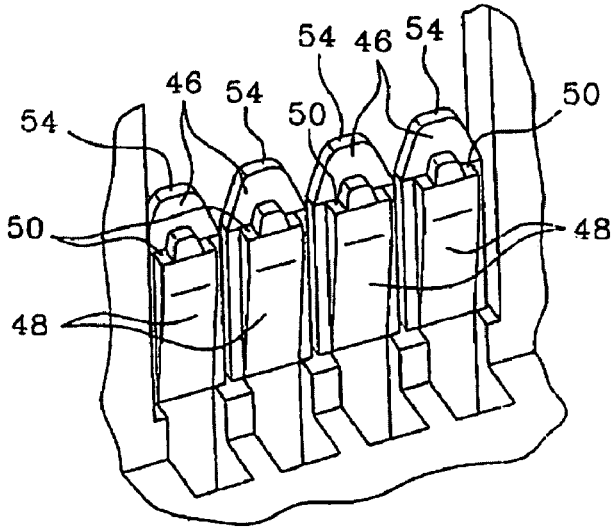
Fig. 2B
ART ANTERIEUR = PRIOR ART

RETAINING DEVICE FOR AN IMPROVED CONTACT

FIELD OF THE INVENTION

The present invention relates to a retaining device for maintaining contact in the form of a flexible arm that can hold a contact, notably a female cage contact, in a socket of a connection box.

BACKGROUND OF THE INVENTION

Connection boxes bearing retaining devices for maintaining contact, which can receive electric contacts, are described in applications U.S. Pat. No. 5,746,624, U.S. Pat. No. 6,068,512, U.S. Pat. No. 5,190,476 and U.S. Pat. No. 5,836,796.

According to the different embodiments, a connection box generally comprises a first part in which sockets are arranged and possibly a second part in the form of a frontal grid.

An electric contact, for example such as described in patent application FR-2,818,027, can come to be housed in these sockets.

Each socket generally comprises an elastic element provided with a bearing surface cooperating with a shoulder created at the level of the electric contact. Thus, in its rest position, the bearing surface of the elastic element is supported against the shoulder and is opposite the contact outlet. The elastic element is sufficiently flexible and comprises an appropriately designed surface, joined to the bearing surface to permit its flattening during introduction of the electric contact.

The electric contact can have different shapes, notably a parallelepiped body, the shoulder being created at the level of an opening provided at the level of the surfaces or formed directly by a part of the rear surface of said body.

In FIGS. 1A and 1B, elastic elements 10 of a connection box are shown in detail, each of them having a bearing surface 12 that can cooperate with a shoulder 14 of an electric contact 16.

According to the different embodiments, the bearing surface and the shoulder have planar surfaces. These planar surfaces assure an absorbing of axial forces but not shearing force. Moreover, there is always some play between the contact and the socket, so that this play combined with the non-absorbing of shearing forces can generate a rapid deterioration of the retaining device.

Document U.S. Pat. No. 4,969,841 proposes an improved retaining device comprising three different bearing surfaces that cooperate with a shoulder and two wings created at the level of the electric contact. Even though this device obtains a better absorption of forces than the devices previously mentioned, it is not entirely satisfactory since it requires a relatively complex form of the elastic element and a particular form of the electric contact, having two wings that project relative to the body.

The present invention also seeks to alleviate the disadvantages of the prior art by proposing an improved retaining device for maintaining an electric contact in a connection box, of simple design, obtaining a better absorption of both axial and shearing forces.

SUMMARY OF THE INVENTION

For this purpose, the subject of this invention is a retaining device that can maintain an electric contact in a connection box socket, said device comprising a bearing surface that can cooperate with a shoulder created at the level of said contact, characterized in that the bearing surface and the shoulder have complementary nonplanar profiles, so as to obtain a contact surface greater than that obtained by planar surfaces having the same width dimension.

According to a preferred form of embodiment, the bearing surface comprises at least one projecting profile, for example in the form of a projection with slightly inclined lateral walls, arranged in roughly symmetrical manner.

The invention also proposes an electric contact designed for said retaining device.

BRIEF DESCRIPTION OF THE DRAWINGS

Other characteristics and inventions will arise from the description that follows of the invention, a description given solely by way of example, with regard to the attached drawings in which:

FIGS. 1A and 1B are perspective views illustrating an electric contact and a retaining device of the prior art, FIGS. 2A and 2B are perspective views illustrating an electric contact and a retaining device according to the invention.

DETAILED DESCRIPTION OF THE INVENTION

Figure 3:
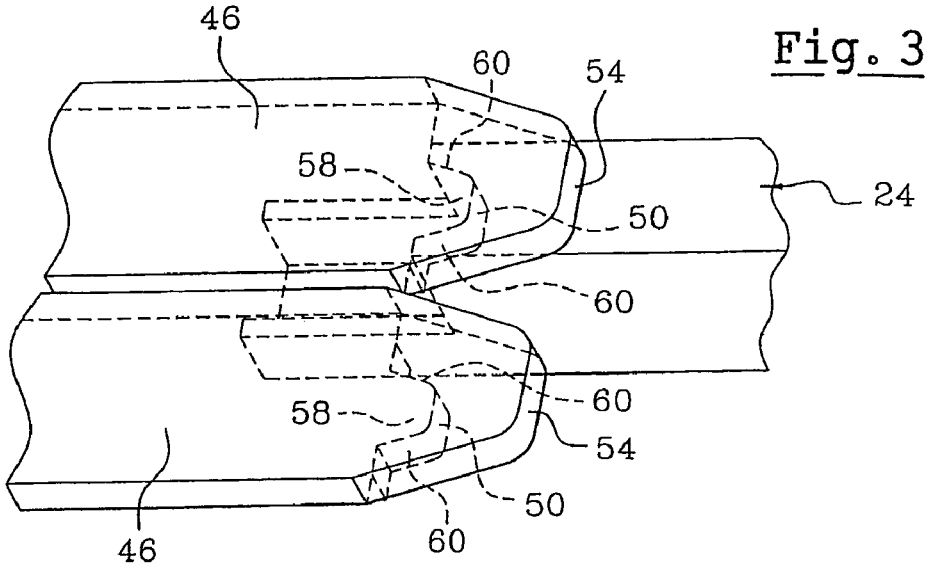
FIG. 3 is a perspective view illustrating the complementary surfaces of an electric contact and a retaining device.
Figure 4:
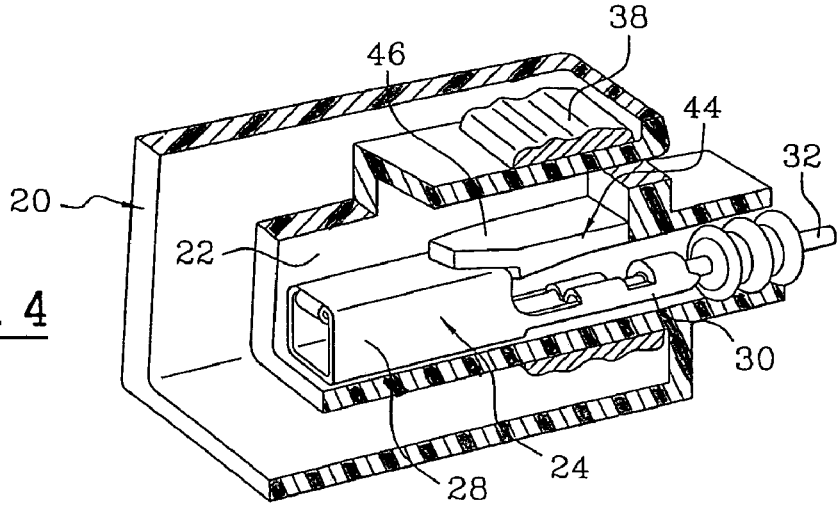
FIG. 4 is a perspective sectional view illustrating a connection box in which an electric contact is inserted, held by a retaining device.
Figure 5:
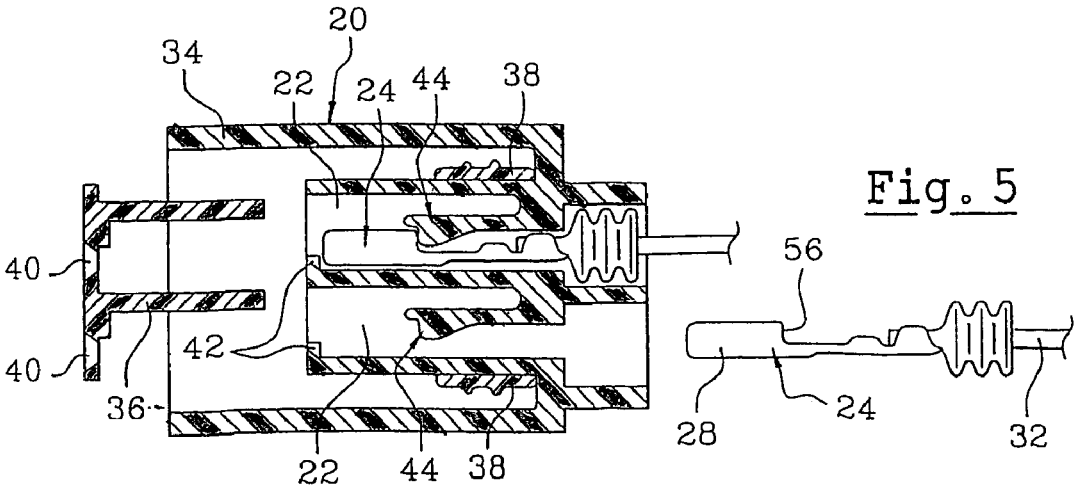
FIG. 5 is a sectional view in a direction parallel to the electric contact illustrating a connection box into which a first electric contact is inserted, and a second electric contact is shown ready to be inserted.

In FIGS. 4 and 5, a connection box 20 is shown, comprising one or more sockets 22 into each of which an electric contact 24 can be inserted.

Electric contact 24 can have different shapes, notably such as described in patent application FR-2,818,027. It generally comprises a body 28, preferably of parallelepiped shape, one part of which can constitute an electric contact zone properly speaking, as well as a rear zone 30 assuring the connection between an electrical cable 32 and said body 28 in the form of a crimping, for example.

The structure of the electric contact is not shown in more detail because it is not the essential element of the present invention and is within the scope of the person skilled in the art.

An example of connection box 20 is shown in detail in FIG. 5. It comprises a first part 34 or block in which one or more sockets 22 are arranged opening up on either side of block 34, positioned in one or more rows, and a second part 36, called grid, that can be embedded in the block and covers one of the faces of the block at the level of which the sockets emerge, an element in the form of a gasket 38 assuring a tight seal with a skirt of a complementary connector. This grid 36 comprises openings 40 positioned at the level of each socket permitting passage of an element that can be connected with the corresponding electric contact of the box.

Each socket 22 has a section more or less adapted to electric contact 24 and comprises a lug 42 positioned more or less at the level of one end opening up close to the grid, able to immobilize electric contact 24 in translation along a first direction, as well as a retaining device 44 in the form of an elastic element permitting the introduction of the electric contact in its socket and immobilizing said contact in translation along a second direction once inserted.

This retaining device 44 is present in the form of a flexible blade 46 connected to box 20, extending in a roughly parallel manner and spaced at a distance to one of the socket surfaces so as to be deformable and to permit the introduction of the electric contact.

This flexible blade 46, sometimes called a locking tongue, comprises a ramp 48 at the level of the face opposite the electric contact, in the direction of introduction of said contact, which is terminated by a bearing surface 50 roughly perpendicular to the principal axis of said blade.

Ramp 48 permits the deformation of blade 46 during introduction of electric contact 24 while bearing surface 50 can cooperate with a shoulder 52 provided at the level of the electric contact and thus can immobilize said contact 24.

Advantageously, bearing surface 50 is far from distal end 54 of blade 46 so as to facilitate unlocking of the retaining device.

Shoulder 52 provided at the level of the contact can be made up by the edge of an opening created in body 28 of the electric contact or, as shown by the different figures, by the rear surface 56 of the body or by a part of this surface.

According to the invention, bearing surface 50 and shoulder 52 have complementary, non-planar profiles, so as to obtain a contact surface superior to that obtained by planar surfaces having the same width dimension. These profiles are advantageously interlocking profiles oriented along an axis parallel to the axis of insertion of the contact into the socket.

According to one embodiment, the bearing surface or shoulder comprises a profile including a projection 58, positioned preferably in a symmetrical manner, with slightly inclined lateral walls 60, the other surface having a complementary profile.

By way of comparison, the planar bearing surface of the prior art, illustrated by FIG. 1B has a surface of 0.63 $mm^2$, while the bearing surface of the invention, illustrated by FIG. 2B has a surface of 0.88 $mm^2$ for the same width dimension, which corresponds to an increase of 40% of the contact surface.

This increase of the contact surface permits either reducing the contact pressure for the same stresses, or increasing the admissible stresses for the same contact pressure, which confers improved mechanical characteristics upon the retaining device according to the invention when compared with devices of the prior art.

Moreover, the nonplanar shape, preferably incorporating at least one projecting profile, permits absorbing both axial and shearing forces.

This projecting shape notably oriented along the principal axis of the blade or of the contact also permits a better immobilization in translation in the transversal direction even when play is present between the electric contact and the socket.

Of course, the invention is clearly not limited to the embodiment shown and described above, but on the contrary covers all the variants, notably with regard to the shapes of the connection box and the electric contact as well as the complementary profiles of the bearing surface and of the shoulder.

The invention claimed is:

1. A retaining device that can maintain an electric contact in a socket of a connection box, said device comprising a bearing surface that can cooperate with a shoulder of said contact, wherein the bearing surface and the shoulder have complementary nonplanar profiles with a contact surface formed at a junction between the bearing surface and the shoulder that is greater than that obtained by planar surfaces having a same width dimension, characterized in that the complementary profiles are interlocking profiles oriented along an axis parallel to the axis of insertion of the contact into the socket.

2. The retaining device according to claim 1, further characterized in that bearing surface comprises at least one projecting profile.

3. The device according to claim 2, further characterized in that bearing surface comprises a projection with slightly inclined lateral walls, positioned roughly symmetrically.

4. An electric contact that can be immobilized in a socket of a connection box by means of a retaining device according to claim 1 comprising a bearing surface that can cooperate with a shoulder created at the level of said contact, such that shoulder and bearing surface have complementary, nonplanar profiles, so as to obtain a greater contact surface than that obtained by planar surfaces having the same width dimension, characterized in that the complementary profiles are interlocking profiles oriented along an axis parallel to the insertion axis of the contact in the socket.

5. The electric contact according to claim 4, further characterized in that shoulder comprises at least one projecting profile.

6. The electric contact according to claim 5, further characterized in that shoulder comprises a projection with slightly inclined lateral walls, positioned in a roughly symmetrical manner.

7. The electric contact according to claim 6, further characterized in that shoulder comprises at least one hollow profile.

8. A system for retaining an electric contact in a connection box comprising:

the connection box comprising a retaining member with a nonplanar bearing surface; and the electric contact comprising a nonplanar shoulder contacted by the nonplanar bearing surface, wherein the nonplanar shoulder and the nonplanar bearing surface each comprise inclined lateral walls which cooperate to form a wedging contact between the nonplanar bearing surface and the nonplanar shoulder.

9. A system as in claim 8 wherein the retaining member comprises a deflectable blade.

10. A system as in claim 9 wherein a distal end of the blade extends in front of the nonplanar bearing surface.

11. A system as in claim 8 wherein the nonplanar bearing surf ace comprises a projection.

12. A system as in claim 8 wherein the nonplanar shoulder comprises a recess.

13. A system as in claim 8 wherein the nonplanar bearing surface and the nonplanar shoulder have complementary mating shapes.

14. A system for retaining an electric contact in a connection box comprising:

the connection box comprising a retaining member with a nonplanar bearing surface; and the electric contact comprising a nonplanar shoulder contacted by the nonplanar bearing surface, wherein the nonplanar shoulder and the nonplanar bearing surface have complementary shapes with a projection section extending into a recess section to form a wedging contact between the bearing surface and the shoulder, and wherein the nonplanar bearing surface comprises the projection section and the nonplanar shoulder comprises the recess section.

15. A system as in claim 14 wherein the projection section comprises at least one inclined lateral wall and the recess section comprises at least one mating inclined lateral wall.

* * * * *